US005577804A

United States Patent [19]

Tedesco

[11] Patent Number: 5,577,804

[45] Date of Patent: Nov. 26, 1996

[54] SEAT HEIGHT ADJUSTMENT MECHANISM FOR A CHAIR

[75] Inventor: Romeo Tedesco, Weston, Canada

[73] Assignee: Global Upholstery Company, Downsview, Canada

[21] Appl. No.: 497,657

[22] Filed: Jun. 30, 1995

[51] Int. Cl.[6] ..... A47C 1/02

[52] U.S. Cl. ..... 297/344.19; 297/463.1

[58] Field of Search ..... 297/344.19, 344.18, 297/344.12, 463.1

[56] References Cited

U.S. PATENT DOCUMENTS

| | | | |
|---|---|---|---|
| Re. 34,381 | 9/1993 | Barnes | 24/590 |
| 3,223,072 | 12/1965 | Bross | 120/42.03 |
| 3,284,135 | 11/1966 | Hiramatsu | 297/361 |
| 3,368,845 | 2/1968 | Watanabe | 297/344.19 X |
| 3,730,019 | 5/1971 | Ballard | 74/502 |
| 4,072,288 | 2/1978 | Wirges et al. | 248/404 |
| 4,076,308 | 2/1978 | Slabon et al. | 297/313 |
| 4,328,943 | 5/1982 | Eldon, III | 248/578 |
| 4,353,594 | 10/1982 | Lowe | 297/307 |
| 4,354,398 | 10/1982 | Porter | 74/501 |
| 4,370,001 | 1/1983 | Örnberg | 297/355 |
| 4,373,692 | 2/1983 | Knoblauch et al. | 248/162.1 |
| 4,383,714 | 5/1983 | Ishida | 297/325 |
| 4,408,800 | 10/1983 | Knapp | 297/285 |
| 4,456,298 | 6/1984 | Gottstein | 297/353 |
| 4,595,237 | 6/1986 | Nelsen | 297/347 |
| 4,681,369 | 7/1987 | Simpson | 297/316 |
| 4,720,143 | 1/1988 | Schwartz et al. | 297/326 |
| 4,743,065 | 5/1988 | Meiller et al. | 297/300 |
| 4,778,216 | 10/1988 | Stupakis | 297/344.19 X |
| 4,956,755 | 9/1990 | Maglica et al. | 362/206 |
| 5,024,484 | 6/1991 | Buchacz | 297/300 |
| 5,069,496 | 12/1991 | Kunh et al. | 297/300 |
| 5,137,330 | 8/1992 | Lie et al. | 297/329 |
| 5,222,783 | 6/1993 | Lai | 297/306 |

*Primary Examiner*—Milton Nelson, Jr.
*Attorney, Agent, or Firm*—Bereskin & Parr; Philip C. Mendes da Costa

[57] ABSTRACT

A chair comprises a seat portion and a support leg including a fluid pressure cylinder. The cylinder has vertically extending telescopic upper and lower sections which are movable between a closed position and an open position. The cylinder also has a valve release member to which an actuator is operatively connected. The valve release member is movable between a first position in which the valve release member is in a closed position and a second position in which the valve release member is in a open position. The actuator has an arm member pivotally mounted on a pivot with respect to the valve. An actuating button, which is positioned proximate the seat portion, is movable between a first position and a second position. A flexible cable having a first end is connected to the button and a second end is operatively connected to the arm member, the ratio of the distance between the pivot and the portion of the arm member to which the cable is affixed to the distance between the pivot member and the valve release member is sufficient to permit the button to be moved from the first position to the second position by the force applied through a finger of the user when the user is seated in the chair.

26 Claims, 8 Drawing Sheets

SEAT HEIGHT ADJUSTMENT MECHANISM FOR A CHAIR

FIELD OF THE INVENTION

This invention relates to a chair such as a pedestal-type office chair, the height of which may be adjusted by actuating a fluid filled cylinder. In particular, the invention relates to an actuating mechanism for a height-adjustable chair which may be actuated by a push button.

BACKGROUND OF THE INVENTION

Many chairs which are used in a commercial environment, such as office chairs, have a height adjusting mechanism for permitting the height of the chair to be raised or lowered to accommodate the user. Typically, height adjustment mechanisms include a fluid filled cylinder, such as a pneumatic cylinder (also known in the industry as gas dampers).

Typically, office chairs comprise a wheeled base, the seat portion of the chair (which may include a chair back) and a support leg extending between the wheeled base and the seat portion. The height adjustment mechanism may employ a telescoping pneumatic cylinder which forms a part of, or may consist of, the support leg. These cylinders have a valve release pin provided thereon. The cylinder is generally in a locked condition but, when the valve release pin is depressed, the cylinder is unlocked permitting it to telescopically extend upwardly or contract downwardly.

Various control linkages for height adjustment mechanisms are known in the art. Examples of these include Kuhn et al (U.S. Pat. No. 5,069,496), Knapp (U.S. Pat. No. 4,408,800), Slabon et al (U.S. Pat. No. 4,076,308), Wirges et al (U.S. Pat. No. 4,072,288), Knoblauch et al (U.S. Pat. No. 4,373,692) and Lai (U.S. Pat. No. 5,222,783). Generally, the pneumatic cylinder is adjusted by a leaver or other mechanism which is positioned beneath the seat of the chair. Accordingly, the user must extend their arm downwardly and then transversely to a position underneath the seat to grasp the lever so that they can actuate the height adjustment mechanism. This operation tends to be difficult particularly if the chair has a large, bulky arm. Since the cylinder is only operable to adjust the height of the chair when the valve release pin is depressed, the operator must move the actuating lever to the open position and hold the lever in the open position while setting the chair in the designated height. As this may require the operator to bend or stoop over, it is difficult to set the height accurately. This is also problematic if the operator has a back problem which prevents such movement.

Nelsen (U.S. Pat. No. 4,595,237) discloses an actuating control for a seat height adjustment mechanism. The mechanism of Nelsen uses a pivotably mounted lever positioned on the bottom of the seat member. Nelson still requires the user to extend their arm downwardly beneath the seat to actuate the lever.

SUMMARY OF THE INVENTION

In accordance with the instant invention, there is provided, a chair comprising a seat portion and an arm rest member; a support leg, said leg including a fluid pressure cylinder connected to said seat portion, said cylinder having vertically extending telescopic upper and lower sections and a valve release member, said valve release member movable between a closed position in which said upper and lower sections are fixed in position relative to each other and an open position in which said upper and lower sections are moveable relative to each other; an actuator operatively connected to said valve release member and movable between a first position, in which said valve release member is in said closed position, and a second position, in which said valve release member is in said open position; actuating button means positioned in said arm rest member and movable between a first position and a second position; and, flexible cable means having a first end connected to said button means and a second end operatively connected to said actuator whereby, when said button means is moved from said first position to said second position, said valve release member is moved to said open position so that the height of the chair may be adjusted and when said button means is moved from said second position to said first position, said valve release member is moved to said closed position so that the height of the chair is then fixed.

In one embodiment of the invention, the actuator comprises an arm member pivotally mounted with respect to said valve, said arm member having a moment arm of sufficient length to permit said button means to move from said first position to said second position by the force applied through a finger of the user when said user is seated in the chair.

In another embodiment of the invention, the actuator comprises a member having a first portion which is pivotally mounted for rotation with respect to said valve, a second portion which is connected to said cable means and a third portion for contacting and moving said valve member whereby when said button means is moved from said first position to said second position, said member pivots causing said valve release member to move to said open position and when said button means is moved from said second position to said first position, said member pivots causing said valve release member to move to said closed position.

Preferably, the button means is pushed inwardly (so as to undergo a inward translational movement). Such a button may include cam means for pulling the cable means when the button means is moved from the first position to the second position. As the button means is moved from the second position, the third portion of the member pivots with respect to the valve member and moves the valve member to the open position.

Preferably, the chair has an arm member and the button is located in the arm member. Thus, the user may operate the chair while in a regular seated position. The user may merely push a button while sitting in the chair and be able to easily move the chair to the desired height. Further, as will be apparent, a person whose back permits them to have only limited movement may be able to easily set the chair to the desired height.

BRIEF DESCRIPTION OF THE DRAWINGS

These and other advantages of the instant invention will be more fully and completely understood by reference to the following drawings of the preferred embodiment of the invention in which.

DESCRIPTION OF THE PREFERRED EMBODIMENT

Figure 1:
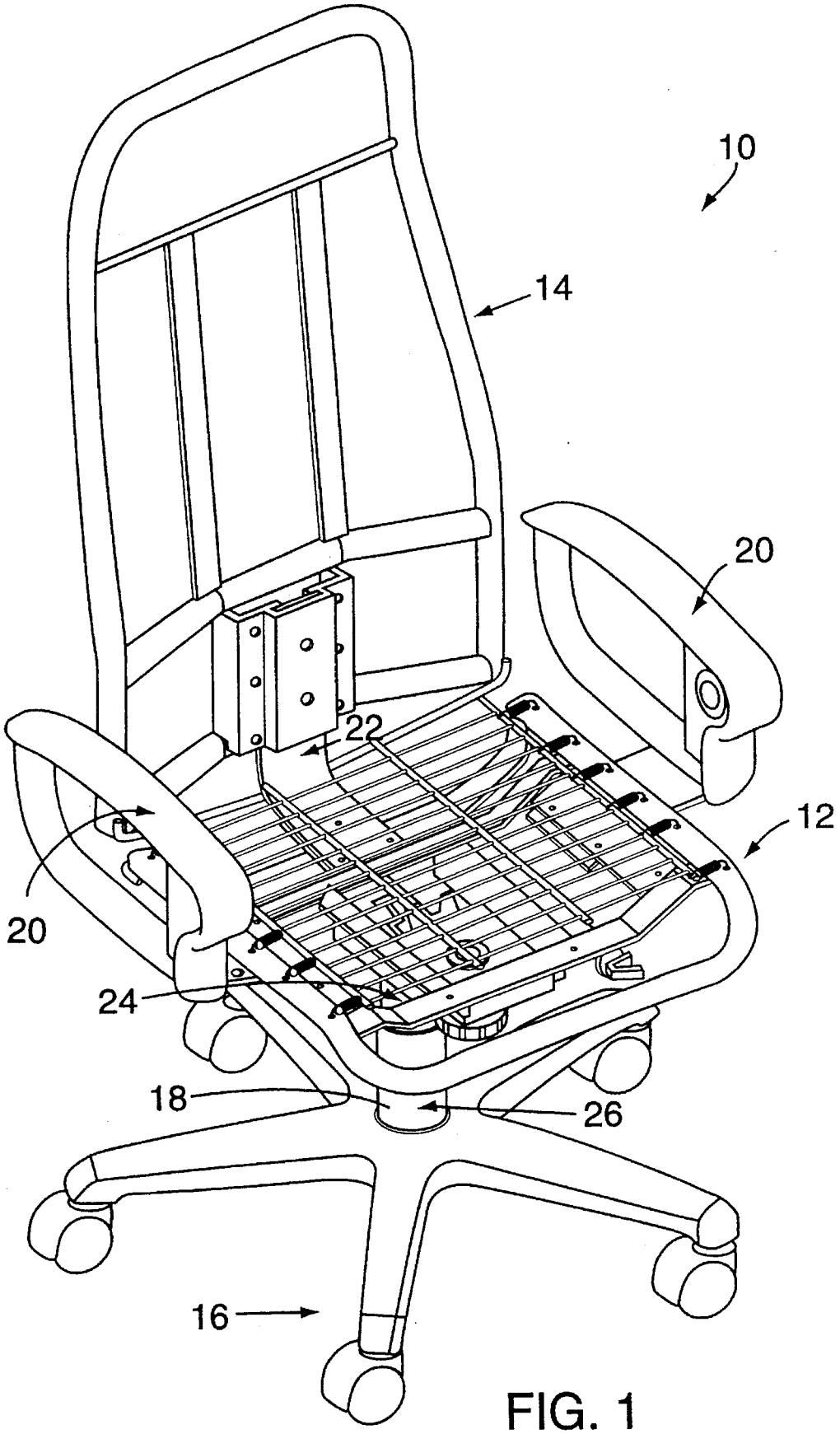
FIG. 1 is a perspective view of a chair according to the instant invention.

Referring to FIG. 1, a pedestal chair is shown. For ease of reference, the foam padding of the chair has been removed so that only the frame members are visible. The chair 10 comprises seat member 12, chair back member 14, wheeled base 16 and support leg 18 extending between seat member 12 and wheeled base 16. Arms 20 are provided on opposite sides of seat member 12.

Chair back member 14 is affixed to seat member 12 by back support member 22. As will be appreciated by those skilled in the art, the chair according to the instant invention need not have a chair back. If the chair includes a chair back, then various means are known in the art for affixing chair back 14 to seat member 12. The chair back may be pivotably mounted with respect to the seat member so that the angle of inclination of chair back 14 may be varied with respect to seat member 12. Alternately, chair back 14 may be fixed in position with respect to seat member 12.

Figure 2:
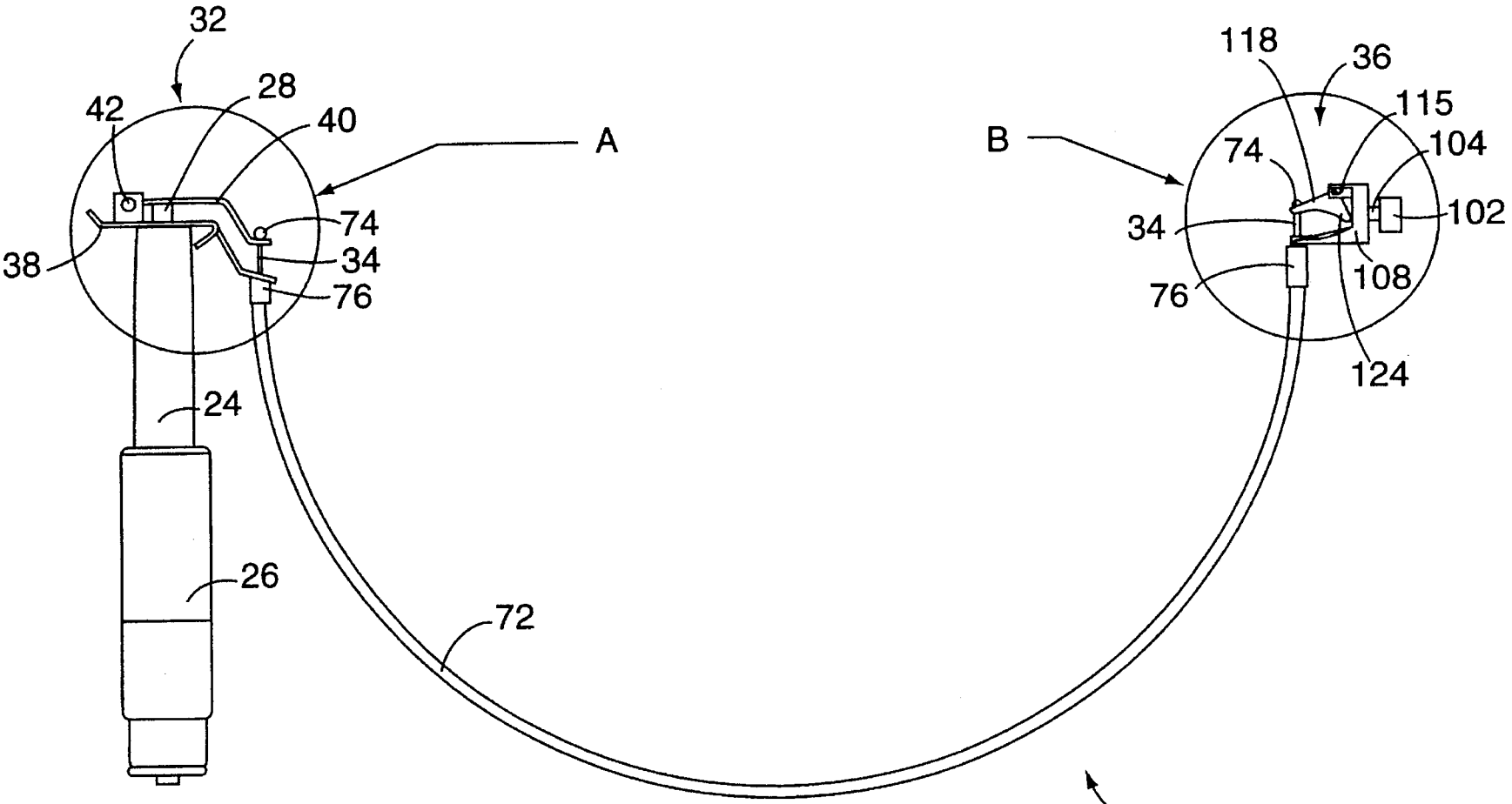
FIG. 2 is a schematic diagram of a height adjustment mechanism according to the instant invention in which the height adjustment mechanism is in the closed position.
Figure 3:
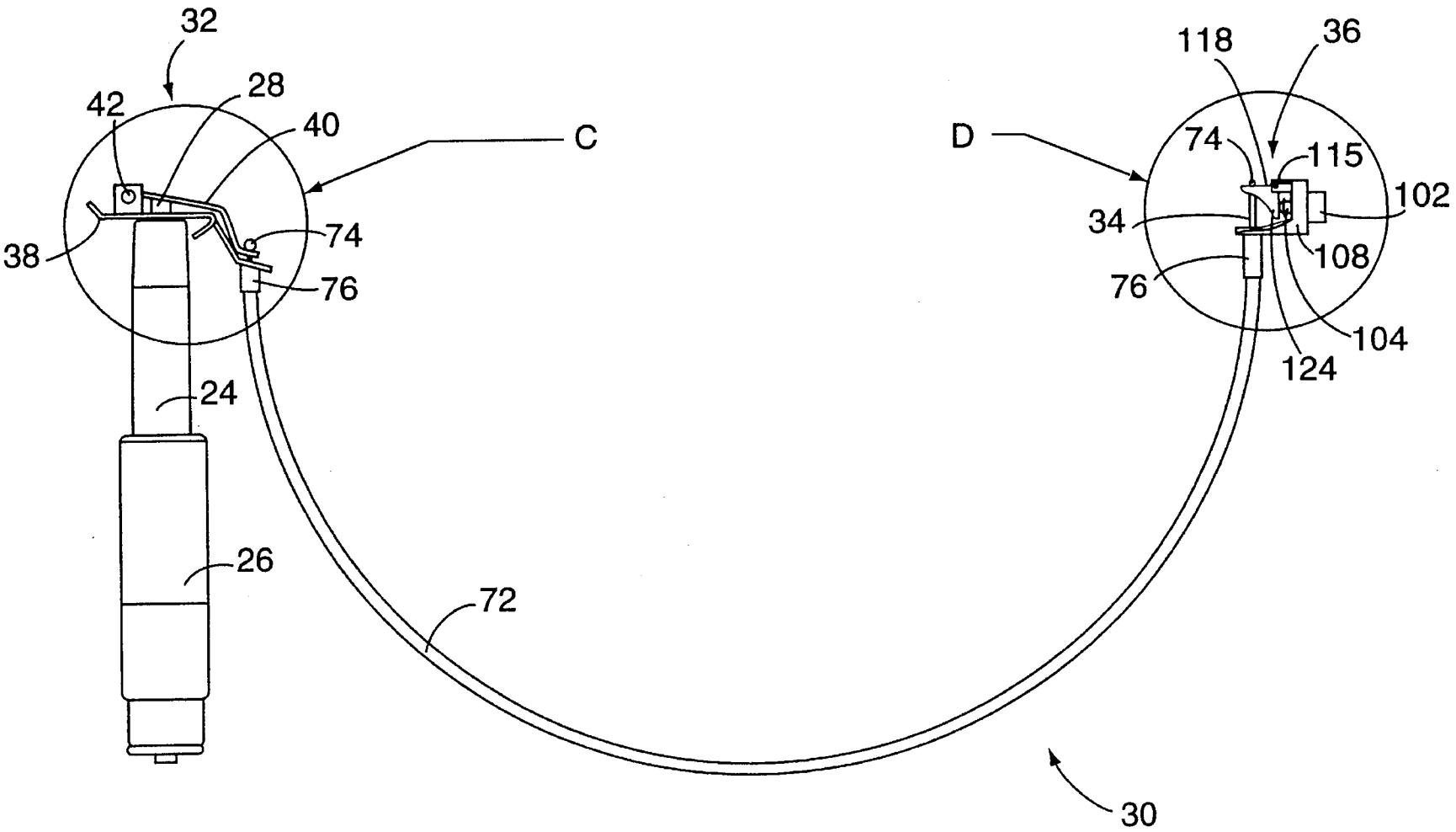
FIG. 3 is a schematic diagram of a height adjustment mechanism according to the instant invention in which the height adjustment mechanism is in the open position.

Support leg 18 comprises a telescoping cylinder having upper section 24, a lower section 26 and a valve release pin 28. The cylinder may be a fluid cylinder and is preferably a pneumatic cylinder. The cylinders are generally known in the art and have two internal chambers (now shown). When the valve release pin is in the closed position as shown in FIG. 2, the chambers are isolated from each other. Accordingly, the cylinder, and therefore the height of the chair, is locked at a predetermined position. When the valve release pin is moved to the open position as shown in FIG. 3, the two chambers are allowed to communicate permitting upper section 24 to move upwardly or downwardly with respect to lower section 24. Thus the height of the chair may be adjusted.

Typically, when the valve is released, the cylinder is designed to cause upward movement of seat member 12 when the seat is unoccupied or at least a significant portion of the user's weight is removed therefrom. By permitting seat member 12 to move upwardly under this pressure, or applying downward pressure (e.g. applying a part of the user's weight to seat member 12) the height of the chair may be decreased. When valve release pin 28 is moved to the closed position, then the communication between the chambers is terminated and the position of upper section 24 with respect to lower section 26 is fixed.

Generally, valve release pin 28 is positioned on the top of upper section 24 (see for example FIG. 2). However, as will be discussed more fully below, due to the construction of the actuator for the height adjustment mechanism of the instant invention, the valve release pin may be positioned at any desired location on the cylinder.

Figure 9:
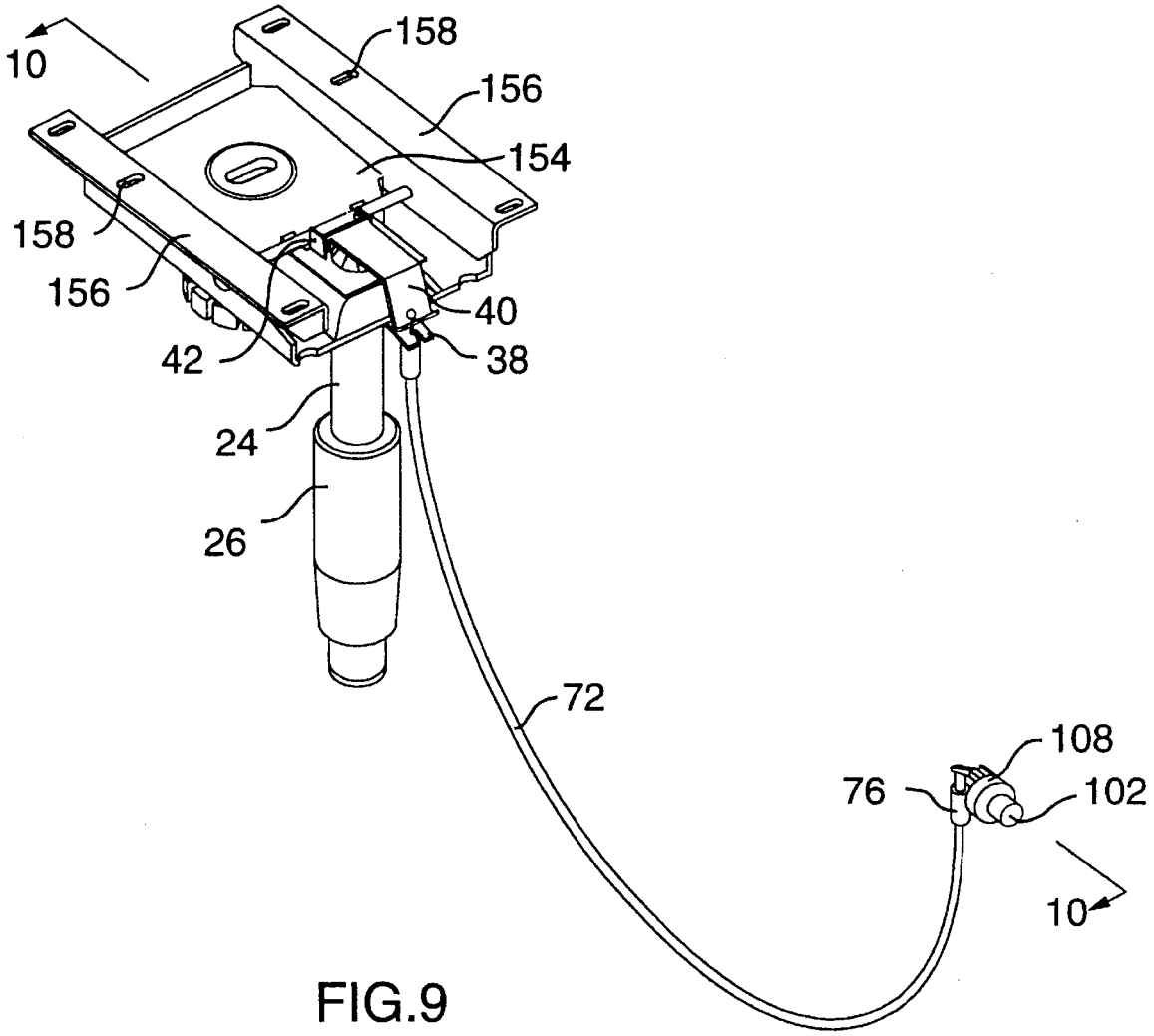
FIG. 9 is a schematic diagram of a height adjustment mechanism according to the instant invention when affixed to the seat support member; and, FIG. 10 is a cross section along line 10—10 in FIG. 9.
Figure 10:
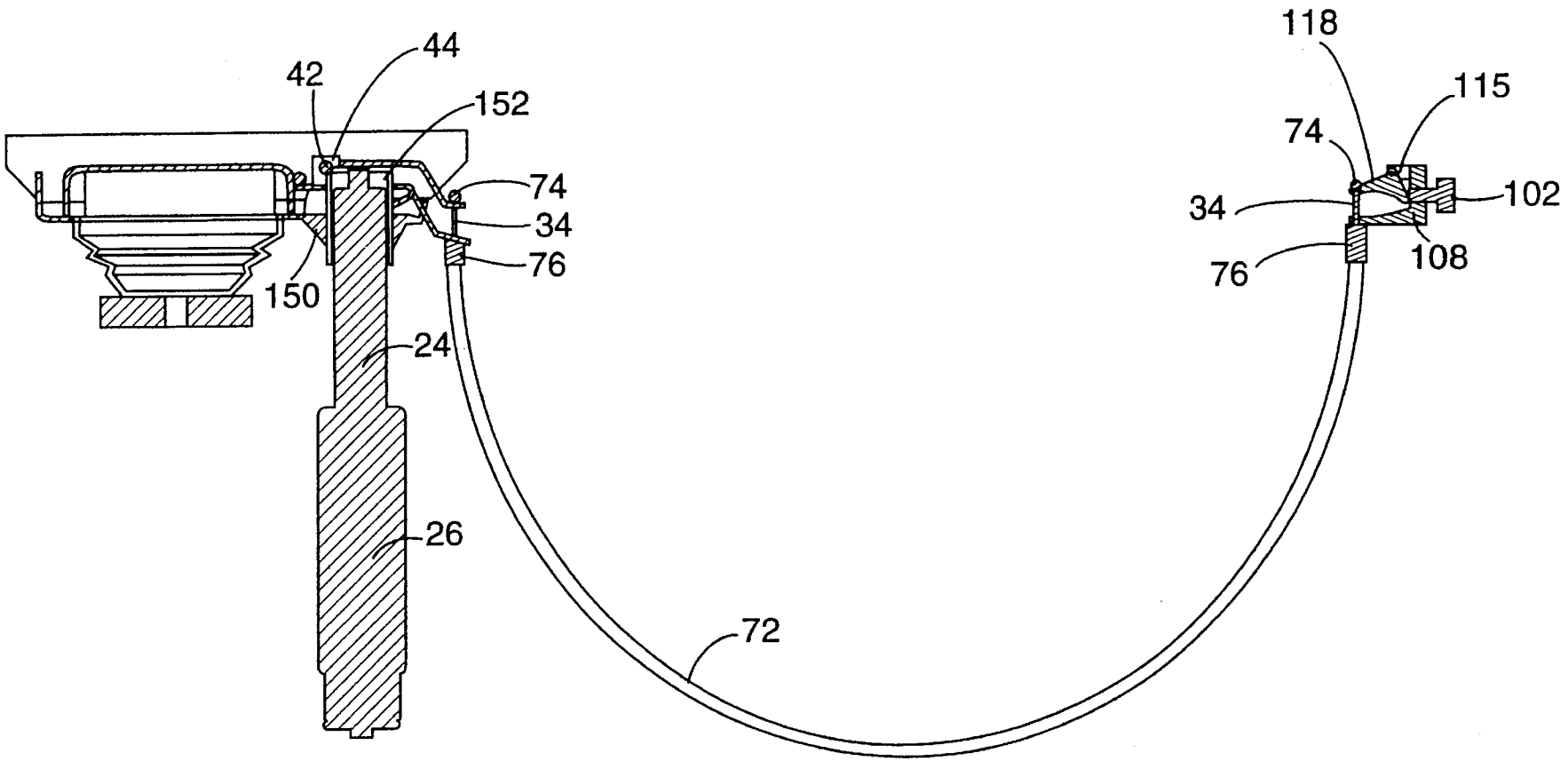

As shown in FIGS. 9 and 10, upper section 24 is received in bushing 150 which has an opening 152. Bushing 150 is a tapered bushing. Similarly, the upper portion of upper section 24 is tappered. Accordingly, upper section 24 is mounted in bushing 152 by means of a taper fit as is known in the art. Bushing 150 is affixed to plate 154. Plate 154 has upraised flanges 156 which have a plurality of openings 158 provided therein. Seat member 12 may be affixed to plate 154 by means of screws passing through openings 158 and into the bottom portion of seat member 12.

Typically, pedestal type chairs may include additional mechanisms to adjust the position of the chair for the comfort of the user. These include means for adjusting the position of chair back member 14 with respect to seat member 12. In addition, chair 10 may include means for tilting seat member 12 with respect to support leg 18. These devices may be mounted, as is normal in the trade, below the seat member. Many of these devices are known in the art and some are referred to in the patents referred to above in the portion of this specification entitled "Background of the Invention". As will be appreciated during the discussion of the instant actuation means, the actuation means of this invention may be used in a chair that contains one or more of these devices.

Referring to FIGS. 2 and 3, actuation mechanism 30 of the instant invention is shown isolated from chair 10. Actuation means 30 comprises actuator 32, button means 36 and cable 34 extending between actuator 32 and button means 36.

As valve release pin 28 is mounted on top of upper section 24 of the cylinder, actuator 32 is also mounted thereon. Actuator 32 has a lower plate 38, upper pivoting arm 40 and pivot axle 42. Pivot axle 42 is mounted between a pair of flanges 44 which extend upwardly from plate 38. Plate 38 is positioned on top of upper section 24 of the cylinder and provides a fixed mount for pivot axle 42. As will be appreciated, plate 38 may be of any particular shape and any particular orientation provided that a fixed mount is provided for pivot axle 42.

In particular, it is appreciated that seat member 12 must be fixed on top of section 24 and that additional mechanisms, including a back angle adjustment mechanism and a tilt mechanism for seat member 12 may be provided or that a different method may be used to affix upper section 24 to seat member 12. The addition of these mechanisms may require a different orientation and configuration for plate 38.

Figure 6:
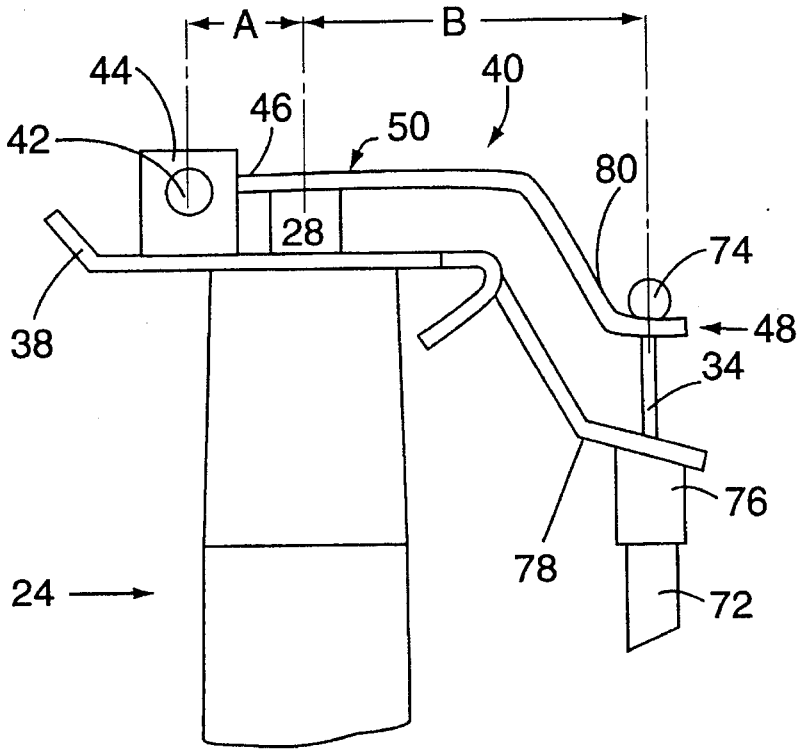
FIG. 6 is an enlargement of detail A of FIG. 2 showing the actuator means in the closed position.
Figure 7:
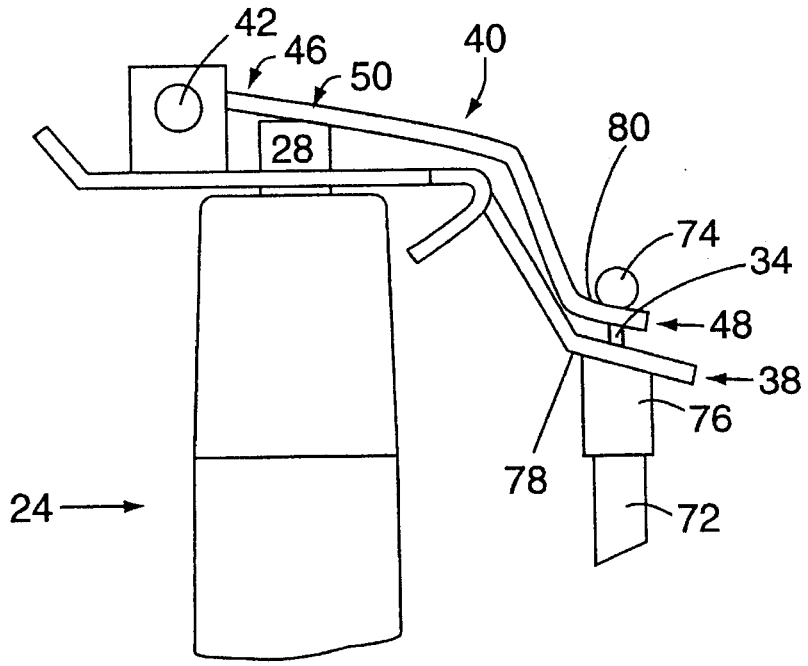
FIG. 7 is an enlargement of detail C of FIG. 3 showing the actuator means in the closed position.

Referring to FIGS. 6 and 7, pivoting arm 40 has a first portion 46, second portion 48 and a third portion 50. First portion 46 is pivotably mounted for rotation about pivot axle 42. Second portion is adapted to be affixed to cable 14. Third portion 50 is adapted for contacting valve 28.

Figure 8:
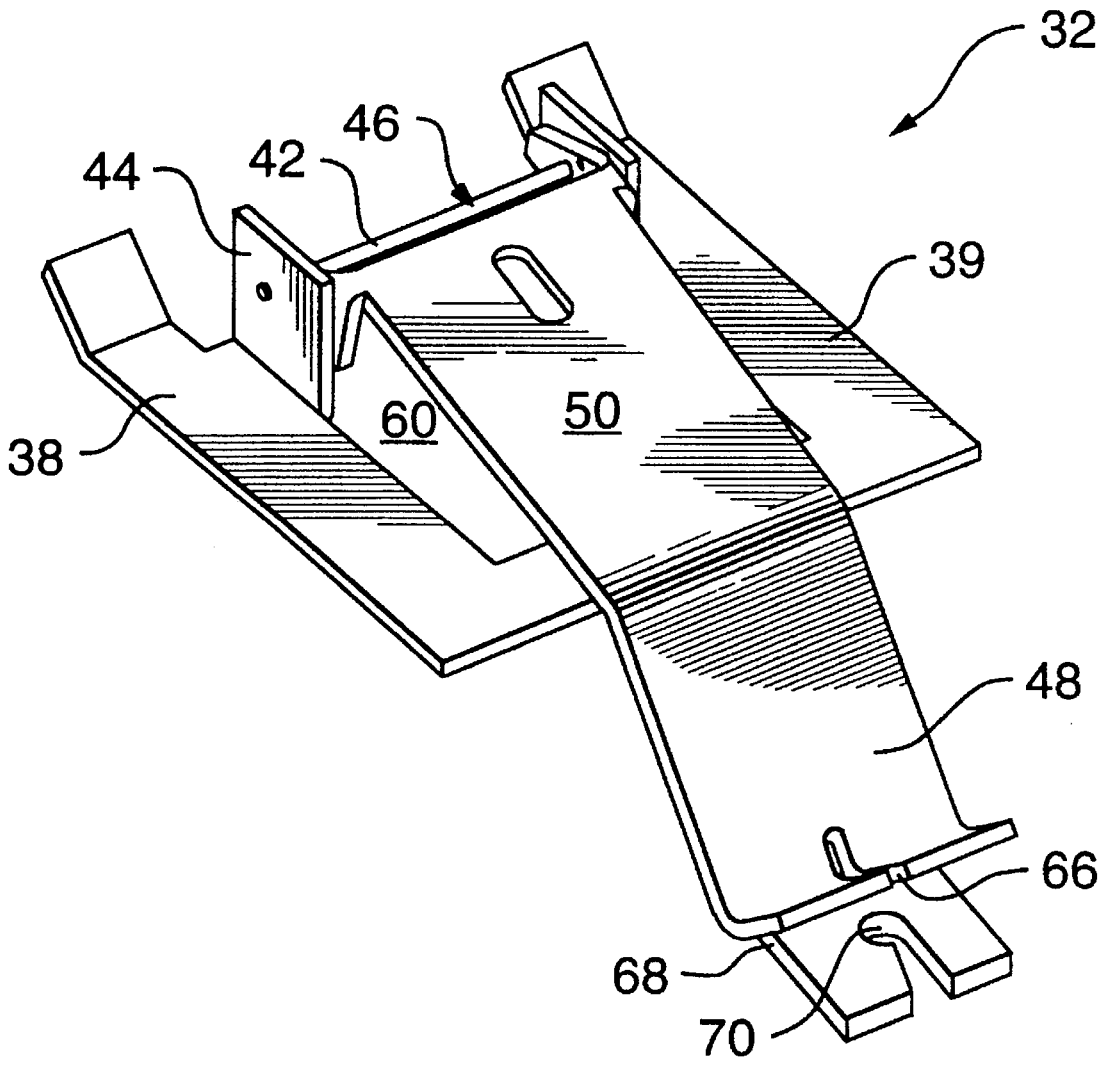
FIG. 8 is a perspective view of an actuator for the height adjustment mechanism.

Referring to FIG. 8, actuator 32 is shown in more detail. As can be seen in this view, plate 38 comprises a longitudinally extending generally flat member 39 having a central opening designated by reference numeral 60. When actuator 32 is positioned on top of upper section 24 of the cylinder, pin 28 extends upwardly through opening 60 and contacts the lower surface of third portion 50. Flanges 44 extend upwardly from generally flat member 39. First portion 46 of pivot arm 40 wraps around pivot axle 42 so that arm 40 may pivot upwardly and downwardly with respect to plate 38.

Second portion 48 of pivot arm 40 has a cable retaining opening 66 provided therein. Plate 38 has a descending portion 68 to match that of arm 40. Opening 70 is provided in the front thereof.

Reference will now be made to FIGS. 6 and 7 which show a schematic of actuator 32 positioned on top of the cylinder with the cable attached. Cable 34 may be made of a variety of materials which may accept a tensional force without breaking, e.g. braided wire. Cable 34 may be sheathed in a plastic or like housing 72 to permit the smooth movement of cable 34 therein. Cable 34 is provided with enlarged end 74. Housing 72 has shoulder members 76 which abut against lower surface 78 of descending portion 68. Cable 34 passes through openings 66 and 70. Enlarged end 74 is retained on upper surface 80 of second portion 48, such as by providing a recess in which enlarged end 74 is seated, while permitting cable 34 to pass through opening 66 and 70.

Figure 4:
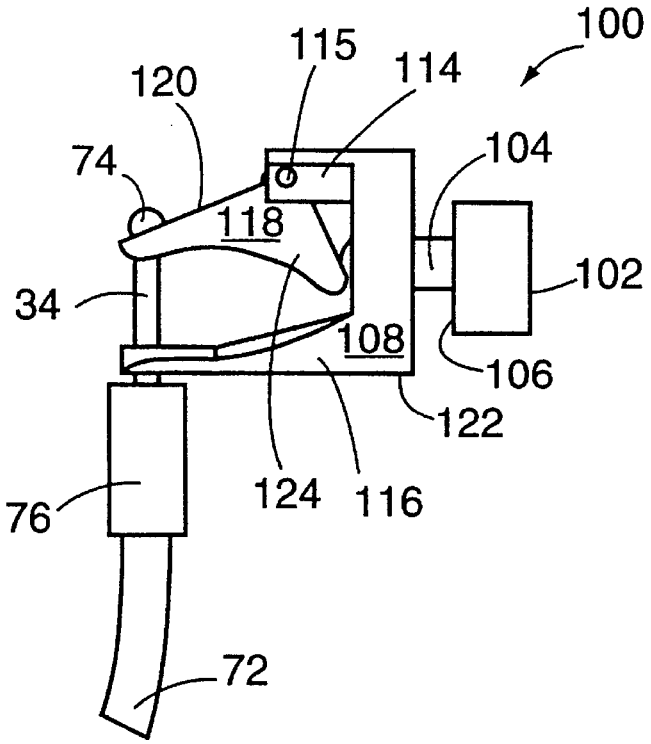
FIG. 4 is an enlargement of detail B of FIG. 2 showing the button means in the closed position.
Figure 5:
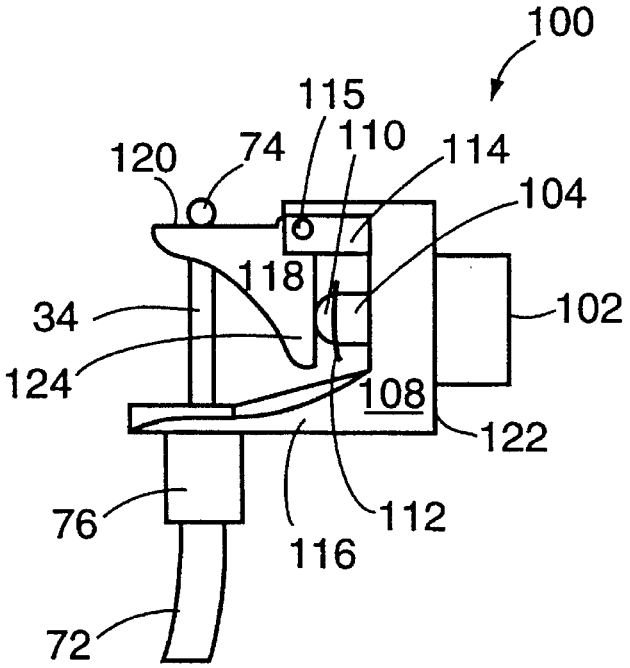
FIG. 5 is an enlargement of detail D of FIG. 3 showing the button means in the open position.

Button means 100 is shown in FIGS. 4 and 5. Button means 100 comprises button 102 and transversely extending member 104. Transversely extending member 104 extends outwardly from rear surface 106 of button 102. Transversely extending member 104 extends through an opening (see FIG. 10) in housing 108. Transversely extending member 104 has distal end 110 on which is provided disk member 112. Disk member 112 has larger diameter than transversely extending member 104 so as to retain button 102 within housing 108.

Housing 108 has a first arm 114 and second arm 116. Cam member 118 is pivotably mounted on pivot axle 115 which is located at the distal end of first arm 114. As discussed above with respect to actuator 32, cable 34 has a shoulder member 76 and the end of cable 34 connected to button means 100 has an enlarged end 74. Cam member 118 is provided with an opening (see FIG. 10) through which cable 34 passes. Enlarged end 74 is retained against surface 120 of cam member 118 such as by providing a recess in which enlarged end 74 is seated. Second arm member 116 has an opening (see FIG. 10) through which cable 34 passes. Shoulder member 76 abuts against lower surface 122 of second arm 116.

It will be appreciated that cable 34 may be retained in first portion 48 and cam member 118 by any means known in the art. Cable 34 may be fixably attached thereto, (e.g. by welding, gluing or the like). Alternately, cable 34 may be removably connected thereto for ease of repair in case cable 34 should break.

Referring to FIGS. 2 and 3, the operation of the actuation means will now be described. Referring first to FIG. 2, valve release pin 28 is shown in the closed position. In this position, pin 28 is in its raised position. Due to the construction of the cylinder, pin 28 is biased into this position so that the cylinder will not be prematurely activated. The pressure exerted by pin 28 against arm 40 causes arm 40 to be maintained in a raised position with respect to plate 38. This force on arm 40 is transmitted through cable 34 and therefore maintains cam member 118 in the position shown in FIG. 2. Arm 124 of cam member 118 transmits this force outwardly through transversely extending member 104 to button 102.

When the user wishes to adjust the height of the chair, they push inwardly on button 102 with, for example, their thumb. This causes button 102 to move to the position shown in FIG. 3. When button 102 is pushed inwardly, transversely extending member 104 pushes on arm 124 of cam member 118 moving cam member 118 to the position shown in FIG. 3. This movement of cam member 118 causes cable 34 to draw arm 40 of actuator 32 downwardly towards plate 38 of actuator 32. By this movement, valve pin 28 is forced downwardly to the open position thus permitting upper section 24 to telescope either upwardly or downwardly with respect to lower section 26. When the chair is being moved to the desired position, the user releases button 102 permitting valve 28 to move arm 40 to the raised position shown in FIG. 3 thus closing the valve. In this position, the chair is once again fixed at a particular, desired height.

Referring to FIG. 6, it will be appreciated that arm 40 provides a moment arm to reduce the pressure which must be exerted by the user to move valve release pin 28 from the closed position to the open position. In particular, the distance between pivot pin 28 and cable 34, referred to by reference numeral B in FIG. 6, provides a moment arm which is substantially longer in the distance between pivot axle 42 and valve release pin 28 (referred to by reference numeral A). By varying the length of moment arm B with respect to A, the amount of force which must be applied, and the distance through which cable 34 must travel, may be adjusted. Preferably, the length of movement arm B with respect to A, and its configuration, are sufficient to permit button 102 to be depressed when a relatively low force is applied by the user, e.g. that pressure which may be applied by the average person. If moment arm B is too long or the distance which must be travelled by second portion 48 is too short, then the height adjustment means may be accidentally actuated by the user by merely brushing against button 102. The ratio of the distances B to A preferably varies from about 1.5:1 to about 5:1, more preferably from about 2:1 to about 4:1 and, most preferably, the ratio is about 3:1.

By constructing actuator 32 according to this invention, the amount of pressure directed downwardly on valve pin 28 by pivot arm 40 may be substantially greater than the pressure required to depress button 102. Preferably, a pressure of from abut 10 to about 20, more preferably from about 15 to about 20 lbs., is required to move valve release pin 28 to the open position. In such a case, the pressure required to move button 102 may vary from about 5 to about 10 lbs. and, more preferably, is about 8 lbs. If the pressure required to move button 102 is less than about 5 lbs., then button 102 may be accidentally actuated by the user brushing against it. If the pressure is greater than about 10 lbs., then the pressure may be too great for many users to easily actuate the height adjustment mechanism. It has been found that a pressure of about 8 lbs. is optimal.

Generally, the arms of chairs are relatively thin. Thus, to fit button means 100 in the arm of a chair, button 102 generally has a relatively short stroke between the released position shown in FIG. 4 and the depressed position shown in FIG. 5. Preferably, the distance travelled by button 102 may be up to about ¾ of an inch but, preferably is about ⅝ of an inch. Correspondingly, the distance travelled by third portion 50 is preferably about ¼ of an inch. Thus, due to the length of movement arm B, the ratio of the distance travelled by button 102 to third portion 50 is about 2:1. This permits about a corresponding increase in the magnitude of the force applied by third portion 50 to valve release pin 28.

It will be appreciated by those skilled in the art that various modifications to actuator 32 may be permissible. For example, if the cylinder was actuated by the outward (upward) movement of valve release pin 28, then, button means 102 could be designed to release tension in cable 34, permitting the expansion outwardly of valve release pin 28, as opposed to providing a tensional force thereto as shown herein. Further, as will be appreciated by those skilled in the art, the exact configuration and orientation of plate 38 may be adjusted so long as a fixed mount is provided for pivot axle 42. Further, the exact configuration and orientation of arm 40 may be varied.

I claim:

1. A chair for a person, comprising:

(a) a seat portion and an arm rest member;

(b) a support leg, said leg including a fluid pressure cylinder connected to said seat portion, said cylinder having vertically extending telescopic upper and lower sections and a valve release member, said valve release member movable between a closed position in which said upper and lower sections are fixed in position relative to each other and an open position in which said upper and lower sections are moveable relative to each other;

(c) an actuator operatively connected to said valve release member and movable between a first position, in which said valve release member is in said closed position, and a second position, in which said valve release member is in said open position;

(d) actuating button means positioned in said arm rest member and movable between a first position and a second position; and, (e) flexible cable means having a first end connected to said button means and a second end operatively connected to said actuator whereby, when said button means is moved from said first position to said second position, said valve release member is moved to said open position so that the height of the chair may be adjusted and when said button means is moved from said second position to said first position, said valve release member is moved to said closed position so that the height of the chair is then fixed.

2. The chair as claimed in claim 1 wherein said button means is positioned in a housing means and said button means travels inwardly into said housing means as said button means passes from its first position to its second position.

3. The chair as claimed in claim 1 wherein said fluid pressure cylinder comprises a gas cylinder.

4. The chair as claimed in claim 1 wherein the distance between said first position and said second position of said button means is up to about ⅝ inch.

5. The chair as claimed in claim 1 wherein said cylinder has a top, said valve release member is positioned adjacent the top of said cylinder and said actuator is positioned above said valve release member, said valve release member moving downwardly as it passes from its closed position to its open position, the movement of said button means from said first position to said second position causing said actuator to move said valve release member downwardly to said open position.

6. The chair as claimed in claim 1 wherein said actuator comprises an arm member pivotally mounted with respect to said valve release member, said arm member having a moment arm of sufficient length to permit said button means to move from said first position to said second position by the force applied through a finger of the person when said person is seated in the chair.

7. The chair as claimed in claim 6 wherein said actuator comprises a pivotally mounted member having a first portion which is pivotally mounted for rotation with respect to said valve release member, a second portion which is connected to said cable means and a third portion for contacting and moving said valve release member whereby when said button means is moved from said first position to said second position, said pivotally mounted member pivots causing said valve release member to move to said open position and when said button means is moved from said second position to said first position, said pivotally mounted member pivots causing said valve release member to move to said closed position.

8. The chair as claimed in claim 7 wherein said button means includes cam means for pulling said cable means when said button means is moved from said first position to said second position such that, as said button means is moved to said second position, said third portion of said member pivots with respect to said valve release member and moves said valve release member to said open position.

9. The chair as claimed in claim 1 wherein a force of from about 15 to about 20 lbs is required to move said valve release member from said closed position to said second position.

10. The chair as claimed in claim 9 wherein the distance between said first position and said second position of said button means is about ¼ inch.

11. The chair as claimed in claim 9 wherein a force of from about 5 to about 10 lbs is required to move said button means from said first position to said second position.

12. The chair as claimed in claim 11 wherein the force to move said button means is about 8 lbs.

13. A chair for a person comprising:

(a) a seat portion;

(b) a support leg, said leg including a fluid pressure cylinder connected to said seat portion, said cylinder having vertically extending telescopic upper and lower sections and a valve release member, said valve release member movable between a closed position in which said upper and lower sections are fixed in position relative to each other and an open position in which said upper and lower sections are moveable relative to each other;

(c) an actuator operatively connected to said valve release member and movable between a first position, in which said valve release member is in said closed position, and a second position, in which said valve release member is in said open position, said actuator having an arm member pivotally mounted on a pivot member with respect to said valve release member;

(d) actuating button means positioned proximate said seat portion and movable between a first position and a second position; and, (e) flexible cable means having a first end connected to said button means and a second end operatively connected to said arm member, a ratio of the distance between said pivot member and the portion of said arm member to which said cable means is affixed to the distance between said pivot member and said valve release member being sufficient to permit said button means to be moved from said first position to said second position by a force applied through a finger of the person when said person is seated in the chair whereby, when said button means is moved from said first position to said second position, said valve release member is moved to said open position so that the height of the chair may be adjusted and when said button means is moved from said second position to said first position, said valve release member is moved to said closed position so that the height of the chair is then fixed.

14. The chair as claimed in claim 13 wherein said ratio is from about 1.5:1 to about 5:1.

15. The chair as claimed in claim 13 wherein said ratio is about 3:1.

16. The chair as claimed in claim 13 wherein said ratio is from about 2:1 to about 4:1.

17. The chair as claimed in claim 16 wherein said button means is positioned in a housing means and said button means travels inwardly into said housing means as said button means passes from its first position to its second position.

18. The chair as claimed in claim 13 wherein said chair includes an arm rest member, said button means is positioned in said arm rest member and said button means travels inwardly into said arm rest member as said button means passes from its first position to its second position.

19. The chair as claimed in claim 18 wherein a force of from about 15 to about 20 lbs is required to move said valve release member from said closed position to said second position.

20. The chair as claimed in claim 19 wherein the distance between said first position and said second position of said button means is about ¼ inch.

21. The chair as claimed in claim 19 wherein a force of from about 5 to about 10 lbs is required to move said button means from said first position to said second position.

22. The chair as claimed in claim 21 wherein the force to move said button means is about 8 lbs.

23. The chair as claimed in claim 22 wherein the distance between said first position and said second position of said button means is up to about ⅝ inch.

24. A chair comprising:

(a) a seat portion;

(b) a support leg, said leg including a fluid pressure cylinder connected to said seat portion, said cylinder having vertically extending telescopic upper and lower sections and a valve release member, said valve release member movable between a closed position in which said upper and lower sections are fixed in position relative to each other and an open position in which said upper and lower sections are moveable relative to each other;

(c) flexible cable means having a first end and a second end;

(d) an actuator operatively connected to said valve release member and movable between a first position, in which said valve release member is in said closed position, and a second position, in which said valve release member is in said open position, said actuator having a member having a first portion which is pivotally mounted for rotation with respect to said valve release member, a second portion which is connected to said second end of said cable means and a third portion for contacting and moving said valve release member;

(e) actuating button means positioned proximate said seat portion and movable between a first position and a second position, said button means is positioned in a housing means and travels inwardly into said housing means as said button means passes from its first position to its second position, said first end of cable means operatively connected to said button means; and, whereby, when said button means is moved from said first position to said second position, said valve release member is moved to said open position so that the height of the chair may be adjusted and when said button means is moved from said second position to said first position, said valve release member is moved to said closed position so that the height of the chair is then fixed.

25. The chair as claimed in claim 24 wherein a force of from about 5 to about 10 lbs is required to move said button means from said first position to said second position.

26. The chair as claimed in claim 24 wherein the force to move said button means is about 8 lbs.

* * * * *